US009080123B2

(12) United States Patent
Motoyama et al.

(10) Patent No.: US 9,080,123 B2
(45) Date of Patent: Jul. 14, 2015

(54) RUST PREVENTIVE OIL COMPOSITION

(75) Inventors: Tadaaki Motoyama, Kanagawa (JP); Junichi Shibata, Kanagawa (JP); Yukio Matsuzaki, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 0 days.

(21) Appl. No.: 12/994,556

(22) PCT Filed: May 21, 2009

(86) PCT No.: PCT/JP2009/059731

§ 371 (c)(1),
(2), (4) Date: Jan. 11, 2011

(87) PCT Pub. No.: WO2009/145240

PCT Pub. Date: Dec. 3, 2009

(65) Prior Publication Data

US 2011/0101280 A1 May 5, 2011

(30) Foreign Application Priority Data

May 27, 2008 (JP) ..... 2008-138455

(51) Int. Cl.

| | |
|---|---|
| ***C10M 125/22*** | (2006.01) |
| ***C23F 11/12*** | (2006.01) |
| ***C23F 11/14*** | (2006.01) |
| ***C10M 141/08*** | (2006.01) |
| ***C10M 141/12*** | (2006.01) |
| ***C23F 11/10*** | (2006.01) |
| ***C23F 11/16*** | (2006.01) |

(52) U.S. Cl.

CPC ..... *C10M 141/08* (2013.01); *C10M 141/12* (2013.01); *C23F 11/10* (2013.01); *C23F 11/141* (2013.01); *C23F 11/143* (2013.01); *C23F 11/145* (2013.01); *C23F 11/163* (2013.01); *C10M 2201/02* (2013.01); *C10M 2203/1006* (2013.01); *C10M 2205/12* (2013.01); *C10M 2205/16* (2013.01); *C10M 2207/026* (2013.01); *C10M 2207/125* (2013.01); *C10M 2207/289* (2013.01); *C10M 2215/04* (2013.01); *C10M 2215/042* (2013.01); *C10M 2215/082* (2013.01); *C10M 2215/223* (2013.01); *C10M 2219/044* (2013.01); *C10M 2227/061* (2013.01); *C10N 2210/02* (2013.01); *C10N 2220/022* (2013.01); *C10N 2230/12* (2013.01); *C10N 2230/52* (2013.01)

(58) Field of Classification Search

CPC .... C23F 11/128; C23F 11/145; C23F 11/163; C23F 11/182; C10M 125/22

USPC ..... 252/388, 392, 395, 396, 389.61, 252/389.62, 390

See application file for complete search history.

(56) References Cited

U.S. PATENT DOCUMENTS

| | | | | |
|---|---|---|---|---|
| 3,791,971 | A * | 2/1974 | Lowe | 508/399 |
| 4,224,170 | A * | 9/1980 | Haugen | 508/399 |
| 6,548,459 | B2 * | 4/2003 | Mondal et al. | 508/457 |

FOREIGN PATENT DOCUMENTS

| | | |
|---|---|---|
| JP | 07-062568 | 3/1995 |
| JP | 09-279368 | 10/1997 |
| JP | 2002-302690 | 10/2002 |
| JP | 2007-039764 | 2/2007 |
| JP | 2007-262543 | 10/2007 |

OTHER PUBLICATIONS

English machine translation of Sugawara et al. JP 2002-302690.*
English machine translation of Nio et al. JP 07-062568.*
Karnok et al., "Wetting agents: What are they, and how do they work?", Jun. 2004. Accessed from http://www2.gcsaa.org/GCM/2004/june04/PDFs/06Wetting.pdf on Dec. 19, 2013.*

* cited by examiner

*Primary Examiner* — Peter F Godenschwager
(74) *Attorney, Agent, or Firm* — Posternak Blankstein & Lund LLP

(57) ABSTRACT

A rust preventive oil composition is provided, which includes: (A) a base oil that is at least one oil selected from a mineral oil and a synthetic oil; (B) 0.1 to 10% by mass of water based on a total mass of the composition; and (C) one or more specific rust preventive additives selected from the group consisting of a sarcosine-type compound, a nonionic surfactant, a sulfonate salt, an ester, an amine, a carboxylic acid, a fatty acid amine salt, a carboxylate salt, paraffin wax, a salt of oxidized wax, and a boron compound, wherein the rust preventive oil composition has a kinetic viscosity of 20 to 100 $mm^2/s$ at 40° C. The rust preventive oil composition can suppress rust development over a long period of time even when there remains a rust-causing agent, which adheres to the metal parts assembled by bare hands, such as steel sheets, bearings, steel balls, and guide rails.

12 Claims, No Drawings

RUST PREVENTIVE OIL COMPOSITION

TECHNICAL FIELD

The present invention relates to rust preventive oil compositions.

BACKGROUND ART

Conventionally, in the field of metal parts such as steel sheets, bearings, steel balls, and guide rails, a rust-causing factor such as chloride adhere to the parts when they are assembled with bare hands. For this reason, countermeasures such as removal of the rust-causing factors by cleaning and application of a rust preventive oil have been taken. Such rust preventive oils generally contain rust preventive additives (corrosion inhibitors), such as sulfonate metal salts, sulfonate amine salts, carboxylic acids, esters, and amines; however, when workpieces are stored for a long period of time, the addition of the rust preventive additives (corrosion inhibitors) alone may not provide a sufficient rust preventive effect. Therefore, the use of a rust preventive oil that contains heavy components such as wax and petrolatum in addition to the rust preventive additives has been proposed to enhance a rust preventive effect by thickening the coating of the rust preventive oil. (See, for example, Patent Document 1).

Furthermore, since a rust preventive oil containing heavy components such as wax has problems such as increased loss caused by adhesion due to increased viscosity, less degreasing, and deterioration of sprayability in the case of spray coating, a method of maintaining a rust preventive effect of a rust preventive oil by formulating sarcosine-type compounds instead of heavy components such as wax has also been proposed. (See, for example, Patent Document 2).

Also, in a conventional metalworking process, two processes, including a cleaning process and a rust prevention process, were unified, and a cleaning and rust preventive composition that produces both a cleaning effect and a rust preventive effect has been proposed (see Patent Document 3). However, the composition does not exhibit a sufficient rust preventive effect over a long period of time.

As described above, in conventional techniques, a rust preventive oil has not been developed yet that exhibits an excellent rust preventive effect over a long period of time for the parts after various metalworking processes or the metal parts assembled by bare hands when they have a rust-causing factor adhered thereto. Therefore, there is a demand for the development of a rust preventive oil that retains a rust preventive effect over a long period of time.

CITATION LIST

Prior Art Documents

Patent Literature

Patent Document 1 Japanese Patent Application Laid-Open No. 2002-302690

Patent Document 2 Japanese Patent Application Laid-Open No. 2007-039764

Patent Document 3 Japanese Patent Application Laid-Open No. 2007-262543

SUMMARY OF THE INVENTION

Problems to be Solved by the Invention

Thus, the present invention was achieved in view of the above circumstances. It is an object of the present invention to provide a rust preventive oil composition that can suppress rust development over a long period of time even when there remains a rust-causing factor, which adheres to the parts after various metalworking processes or to the metal parts assembled by bare hands, such as steel sheets, bearings, steel balls, and guide rails.

Means for Solving the Problems

As a result of dedicated research to solve such problems as described above, the inventors have found a composition in which a rust preventive oil having a specific composition can retain a rust preventive effect over an unconventionally long period of time, even when there remains a rust-causing factor, which adheres to the parts after various metalworking processes or to the metal parts assembled by bare hands. Thus, the present inventors accomplished the present invention.

Thus, the present application relates to a rust preventive oil composition including: (A) a base oil that is at least one selected from a mineral oil and a synthetic oil; (B) 0.1 to 10% by mass of water based on the total mass of the composition; and (C) one or more specific rust preventive additives selected from the group consisting of a sarcosine-type compound, a nonionic surfactant, a sulfonate salt, an ester, an amine, a carboxylic acid, a fatty acid amine salt, a carboxylate salt, paraffin wax, a salt of oxidized wax, and a boron compound, wherein the rust preventive oil composition has a kinetic viscosity of 20 to 100 $mm^2/s$ at 40° C.

The present invention also relates to a rust preventive oil composition wherein among the rust preventive additives, the sulfonate salt is an amine sulfonate and the ester is a partial ester of a polyalcohol.

The present invention also relates to a rust preventive oil composition wherein the sulfonate salt and/or the carboxylate salt is a calcium salt.

The present invention also relates to a rust preventive oil composition wherein a base number is 1 to 25 mgKOH/g.

The present invention also relates to a rust preventive oil composition that maintains A-ranked rust development (0% rust development) for 10 or more hours in a neutral salt spray test defined in JIS K2246 "Rust preventive oils".

Effects of the Invention

As described above, according to the present invention, rust development can be suppressed over a long period of time by formulating a specific rust preventive agent, even when there remains a rust-causing factor, which adheres to the metal parts, such as steel sheets, bearings, steel balls, and guide rails, for example when they were assembled with bare hands.

MODE FOR CARRYING OUT THE INVENTION

The rust preventive oil composition of the present invention includes (A) a base oil composed of a mineral oil and/or a synthetic oil.

Specific examples of mineral oils include paraffin-base or naphthene-base mineral oils. They are obtained by combining one or more refining processes such as solvent deasphalting, solvent extraction, hydrocracking, solvent dewaxing, catalytic dewaxing, hydrorefining, sulfuric acid treatment, and clay treatment as appropriate, to the lubricating oil distillate obtained by subjecting crude oil to atmospheric distillation or vacuum distillation.

Meanwhile, polyolefins, alkylbenzenes, and the like are preferably used as a synthetic oil.

Examples of polyolefins include a homopolymer or a copolymer of olefin monomers with a carbon number of 2 to 16, and preferably with a carbon number of 2 to 12, as well as hydrogenated products of such polymers. It should be noted that, when the polyolefin is a copolymer composed of structurally different olefin monomers, there is no particular limitation to the ratio of monomers or the arrangement of monomers in the copolymer. The copolymer may be any of a random copolymer, an alternating copolymer, and a block copolymer. The olefin monomer may also be any of an alpha olefin, an internal olefin, a linear olefin, and a branched olefin. Specific examples of such olefin monomers include ethylene, propylene, 1-butene, 2-butene, isobutene, linear or branched pentene (including an alpha olefin and an internal olefin), linear or branched hexene (including an alpha olefin and an internal olefin), linear or branched heptene (including an alpha olefin and an internal olefin), linear or branched octene (including an alpha olefin and an internal olefin), linear or branched nonene (including an alpha olefin and an internal olefin), linear or branched decene (including an alpha olefin and an internal olefin), linear or branched undecene (including an alpha olefin and an internal olefin), linear or branched dodecen (including an alpha olefin and an internal olefin), linear or branched tridecene (including an alpha olefin and an internal olefin), linear or branched tetradecen (including an alpha olefin and an internal olefin), linear or branched pentadecene (including an alpha olefin and an internal olefin), and linear or branched hexadecene (including an alpha olefin and an internal olefin), and mixtures thereof. Among these, ethylene, propylene, 1-butene, 2-butene, isobutene, alpha olefins with a carbon number of 5 to 12, mixtures thereof, and the like are preferably used. Furthermore, 1-octene, 1-decene, 1-dodecen, mixtures thereof, and the like are more preferred among the alpha olefins with a carbon number of 5 to 12.

The above-mentioned polyolefins can be manufactured by a conventionally known method. Although the polyolefins produced by a conventionally known method usually have a double bond, so-called hydrogenated polyolefins, which are produced by hydrogenating double-bonded carbon atoms in these polyolefins, are preferably used as a base oil in the present invention. Use of a hydrogenated polyolefin tends to improve thermal stability and oxidation stability of the rust preventive oil composition to be obtained. It should be noted that a hydrogenated polyolefin can be produced, for example, by hydrogenating a polyolefin in the presence of a known hydrogenation catalyst, thereby saturating the double bonds in the polyolefin. It is also possible to complete both the polymerization of olefins and the hydrogenation of the double bonds in the resultant polymer in one process instead of undergoing two processes, which are the polymerization of olefins and the hydrogenation of the resultant polymer. This is achieved by selecting a specific catalyst to be used in performing a polymerization reaction of olefins.

Among the polyolefins that are preferably used as a base oil in the present invention, an ethylene-propylene copolymer, polybutene (a copolymer obtained by polymerization of a butane-butene fraction (a mixture of 1-butene, 2-butene, and isobutene) that is a byproduct generated in naphtha thermal cracking), a 1-octene oligomer, a 1-decene oligomer, a 1-dodecen oligomer, and hydrogenated products thereof, as well as mixtures thereof, and the like are preferred. This is because they have excellent thermal stability, oxidation stability, viscosity-temperature characteristics, and low temperature fluidity. In particular, a hydrogenated ethylene-propylene copolymer, a hydrogenated polybutene, a hydrogenated 1-octene oligomer, a hydrogenated 1-decene oligomer, a hydrogenated 1-dodecen oligomer, and mixtures thereof are more preferred. It should be noted that synthetic oils commercially available as a base oil for lubricating oils, such as an ethylene-propylene copolymer, polybutene, and poly (alpha-olefin) usually have pre-hydrogenated double bonds. These commercially available oils may also be used as a base oil in the present invention.

Furthermore, an alkylbenzene preferably used as a base oil in the present invention preferably has 1 to 4 alkyl groups with a carbon number of 1 to 40 in the molecule. Specific examples of alkyl groups with a carbon number of 1 to 40 as used herein include a methyl group, an ethyl group, a propyl group (including all isomers thereof), a butyl group (including all isomers thereof), a pentyl group (including all isomers thereof), a hexyl group (including all isomers thereof), a heptyl group (including all isomers thereof), an octyl group (including all isomers thereof), a nonyl group (including all isomers thereof), a decyl group (including all isomers thereof), an undecyl group (including all isomers thereof), a dodecyl group (including all isomers thereof), a tridecyl group (including all isomers thereof), a tetradecyl group (including all isomers thereof), a pentadecyl group (including all isomers thereof), a hexadecyl group (including all isomers thereof), a heptadecyl group (including all isomers thereof), an octadecyl group (including all isomers thereof), a nonadecyl group (including all isomers thereof), an icosyl group (including all isomers thereof), a henicosyl group (including all isomers thereof), a docosyl group (including all isomers thereof), a tricosyl group (including all isomers thereof), a tetracosyl group (including all isomers thereof), a pentacosyl group (including all isomers thereof), a hexacosyl group (including all isomers thereof), a heptacosyl group (including all isomers thereof), an octacosyl group (including all isomers thereof), a nonacosyl group (including all isomers thereof), a triacontyl group (including all isomers thereof), a hentriacontyl group (including all isomers thereof), a dotriacontyl group (including all isomers thereof), a tritriacontyl group (including all isomers thereof), a tetratriacontyl group (including all isomers thereof), a pentatriacontyl group (including all isomers thereof), a hexatriacontyl group (including all isomers thereof), a heptatriacontyl group (including all isomers thereof), an octatriacontyl group (including all isomers thereof), a nonatriacontyl group (including all isomers thereof), and a tetracontyl group (including all isomers thereof). Furthermore, although an alkyl group of the alkylbenzene of the present invention may be linear or branched, a branched alkyl group is preferred in terms of stability and viscosity characteristic, for example. A branched alkyl group that is derived from an olefin oligomer, such as propylene, butene, and isobutylene is more preferred because of their especially easy availability.

Preferably, the number of alkyl groups in the alkylbenzene used in the present invention is 1 to 4. From the viewpoint of stability and availability, an alkylbenzene having 1 or 2 alkyl groups, i.e., a monoalkyl benzene, a dialkyl benzene, or mixtures thereof are most preferred. Furthermore, the alkylbenzene is not necessarily the one having a single structure and may be a mixture of alkylbenzenes having different structures.

In the present invention, although each of the above-mentioned base oils may have any kinetic viscosity at 40° C., the kinetic viscosity is selected from a range preferably from 1 to 500 $mm^2/s$, more preferably from 2 to 300 $mm^2/s$, and even more preferably from 5 to 200 $mm^2/s$. These base oils may be used alone or as a mixture of two or more base oils.

Furthermore, although the content of the base oil in the rust preventive oil composition of the present invention is not particularly limited and may be any amount, the lower limit of the base oil is 50% by mass, preferably 70% by mass, and more preferably 80% by mass relative to a composition.

The composition of the present invention contains water. Water herein includes industrial water, tap water, ion exchange water, distilled water, water treated with activated carbon or a water purifier for general household use, water generated by absorbing the moisture in the air, and the like. Any of these types of water may be used.

In the composition of the present invention, the lower limit of water content is 0.1% by mass and the upper limit is 10% by mass based on the total mass of the composition. The lower limit of water content is 0.1% by mass or more, preferably 0.2% by mass or more, and most preferably 0.5% by mass or more in terms of suppression of rust development. On the other hand, the upper limit of the water content is 10% by mass or less, and more preferably 9% by mass or less in terms of suppression of rust development and stability of the water against separation.

Exemplary methods to mix water may include, but not limited to, the following: (1) a method in which water is premixed with a surfactant and the mixture is added to a base oil; (2) a method in which water is blended and dispersed forcedly using an agitator such as a homogenizer; (3) a method in which water is blended and dispersed forcedly by blowing steam into a base oil; and (4) a method in which the rust preventive oil composition of the present invention is applied onto metal parts and then the moisture in the air is allowed to be naturally absorbed therein.

Furthermore, the component (C) in the present invention includes one or more specific rust preventive additives selected from the group consisting of a sarcosine-type compound, a nonionic surfactant, a sulfonate salt, an ester, an amine, a carboxylic acid, a fatty acid amine salt, a carboxylate salt, paraffin wax, a salt of oxidized wax, and a boron compound.

Sarcosine-type compounds used in the present invention have a structure represented by the following general formula (1), (2), or (3):

$$R^1—CO—NR^2—(CH_2)_n—COOX \quad (1)$$

(wherein $R^1$ represents an alkyl group with a carbon number of 6 to 30 or an alkenyl group with a carbon number of 6 to 30; $R^2$ represents an alkyl group with a carbon number of 1 to 4; X represents a hydrogen atom, an alkyl group with a carbon number of 1 to 30, or an alkenyl group with a carbon number of 1 to 30; and n represents an integer of 1 to 4);

$$[R^1—CO—NR^2—(CH_2)_n—COO]_mY \quad (2)$$

(wherein $R^1$ represents an alkyl group with a carbon number of 6 to 30 or an alkenyl group with a carbon number of 6 to 30; $R^2$ represents an alkyl group with a carbon number of 1 to 4; Y represents an alkali metal or an alkaline earth metal; n represents an integer of 1 to 4; and m represents 1 if Y is an alkali metal and represents 2 if Y is an alkaline earth metal);

$$[R^1—CO—NR^2—(CH_2)_n—COO]_m—Z—(OH)_{m'} \quad (3)$$

(wherein $R^1$ represents an alkyl group with a carbon number of 6 to 30 or an alkenyl group with a carbon number of 6 to 30; $R^2$ represents an alkyl group with a carbon number of 1 to 4; Z represents a moiety other than the hydroxyl groups of a dihydric or higher polyalcohol; m represents an integer of 1 or more; m' represents an integer of 0 or more; m+m' represents the valence of Z; and n represents an integer of 1 to 4).

In the general formulas (1) to (3), $R^1$ represents an alkyl group with a carbon number of 6 to 30 or an alkenyl group with a carbon number of 6 to 30. It is necessary that the alkyl group or the alkenyl group have 6 or more carbon atoms in terms of solubility in the base oil, for example. The alkyl group or the alkenyl group has preferably 7 or more carbon atoms, and more preferably 8 or more carbon atoms. Additionally, it is necessary that the alkyl group or the alkenyl group have 30 or less carbon atoms in terms of storage stability, for example. The alkyl group or the alkenyl group has preferably 24 or less carbon atoms, and more preferably 20 or less carbon atoms. Specific examples of such alkyl groups and alkenyl groups include alkyl groups, such as a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, and an icosyl group (these alkyl groups may be linear or branched); and alkenyl groups, such as a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, and an icosenyl group (these alkenyl groups may be linear or branched, and may have a double bond at any position).

In the general formulas (1) to (3), $R^2$ represents an alkyl group with a carbon number of 1 to 4. It is necessary that the alkyl group have 4 or less carbon atoms in terms of storage stability, for example. The alkyl group has preferably 3 or less carbon atoms, and more preferably 2 or less carbon atoms. In the general formulas (1) to (3), n represents an integer of 1 to 4. It is necessary that n be an integer of 4 or less in terms of storage stability, for example. n is preferably 3 or less, and more preferably 2 or less.

In the general formula (1), X represents a hydrogen atom, an alkyl group with a carbon number of 1 to 30, or an alkenyl group with a carbon number of 1 to 30. It is necessary that the alkyl group or the alkenyl group represented by X have 30 or less carbon atoms in terms of storage stability, for example. The alkyl group or the alkenyl group has preferably 20 or less carbon atoms, and more preferably 10 or less carbon atoms. Specific examples of such alkyl groups and alkenyl groups include alkyl groups, such as a methyl group, an ethyl group, a propyl group, a butyl group, a pentyl group, a hexyl group, a heptyl group, an octyl group, a nonyl group, and a decyl group (these alkyl groups may be linear or branched); and alkenyl groups, such as an ethenyl group, a propenyl group, a butenyl group, a pentenyl group, a hexenyl group, a heptenyl group, an octenyl group, a nonenyl group, and a decenyl group (these alkenyl groups may be linear or branched, and may have a double bond at any position). Furthermore, an alkyl group is more preferred due to a better rust preventive effect, for example. X is preferably a hydrogen atom, an alkyl group with a carbon number of 1 to 20, or an alkenyl group with a carbon number of 1 to 20, and more preferably a hydrogen atom or an alkyl group with a carbon number of 1 to 20, and even more preferably a hydrogen atom or an alkyl group with a carbon number of 1 to 10 due to a better rust preventive effect, for example.

In the general formula (2), Y represents an alkali metal or an alkaline earth metal. Specific examples include sodium, potassium, magnesium, calcium, and barium. An alkaline earth metal is preferred among these due to a better rust preventive effect. The use of barium may lead to insufficient safety regarding the human body or the ecosystem. In the general formula (2), m represents 1 if Y is an alkali metal, and represents 2 if Y is an alkaline earth metal.

In the general formula (3), Z represents a moiety other than the hydroxyl groups of a dihydric or higher polyalcohol. Specific examples of such polyalcohols include dihydric alcohols, such as ethylene glycol, propylene glycol, 1,4-butanediol, 1,2-butanediol, neopentyl glycol, 1,6-hexanediol, 1,2-octanediol, 1,8-octanediol, isoprene glycol, 3-methyl-1,5-pentanediol, sorbite, catechol, resorcin, hydroquinone, bisphenol A, bisphenol F, hydrogenated bisphenol A, hydrogenated bisphenol F, and a dimer diol; trihydric alcohols, such as glycerol, 2-(hydroxymethyl)-1,3-propanediol, 1,2,3-butanetriol, 1,2,3-pentanetriol, 2-methyl-1,2,3-propanetriol, 2-methyl-2,3,4-butanetriol, 2-ethyl-1,2,3-butanetriol, 2,3,4-pentanetriol, 2,3,4-hexanetriol, 4-propyl-3,4,5-heptanetriol, 2,4-dimethyl-2,3,4-pentanetriol, 1,2,4-butanetriol, 1,2,4-pentanetriol, trimethylolethane, and trimethylolpropane; tetrahydric alcohols, such as pentaerythritol, erythritol, 1,2,3,4-pentanetetrol, 2,3,4,5-hexanetetrol, 1,2,4,5-pentanetetrol, 1,3,4,5-hexanetetrol, diglycerol, and sorbitan; pentahydric alcohols, such as adonitol, arabitol, xylitol, and triglycerol; hexahydric alcohols, such as dipentaerythritol, sorbitol, mannitol, iditol, inositol, dulcitol, talose, and allose; and polyglycerol or dehydration-condensation products thereof.

In the general formula (3), m represents an integer of 1 or more; m' represents an integer of 0 or more; and m+m' is equal to the valence of Z. In other words, all the hydroxyl groups in the polyalcohol Z may be substituted or only some of them may be substituted.

Among the sarcosines represented by the above-mentioned general formulas (1) to (3), at least one compound selected from those represented by the general formula (1) or (2) is preferred since it has a better rust preventive effect. Also, only one compound may be selected from those represented by the general formulas (1) to (3) and used alone, or a mixture of two or more of the compounds may be used.

Although the content of the sarcosine represented by the general formulas (1) to (3) in the rust preventive oil composition of the present invention is not particularly limited, it is preferably 0.05 to 10% by mass, more preferably 0.1 to 7% by mass, and even more preferably 0.3 to 5% by mass based on the total mass of the composition. When the content of the sarcosine is less than the above-mentioned lower limit, the rust preventive effect and long-term sustainability thereof tend to be insufficient. Also, when the content of the sarcosine is more than the above-mentioned upper limit, the rust preventive effect and long-term sustainability thereof tend not to be improved as much as expected based on the content.

Specific examples of nonionic surfactants used in the present invention include an alkylene glycol, a polyoxyalkylene glycol, a polyoxyalkylene alkyl ether, a polyoxyalkylene aryl ether, a fatty acid ester of the polyoxyalkylene adduct of a polyalcohol, a polyoxyalkylene fatty acid ester, a polyoxyalkylene alkylamine, and an alkyl alkanolamide. Among these, an alkylene glycol, a polyoxyalkylene glycol, a polyoxyalkylene alkyl ether, a polyoxyalkylene aryl ether, and a polyoxyalkylene alkylamine are preferred, and in particular, a polyoxyalkylene alkylamine is preferred as a nonionic surfactant used in the present invention, since they exhibit a better rust preventive effect on the rust preventive oil composition of the present application.

Specific examples of the alkylene glycols include ethylene glycol, propylene glycol, butylene glycol, pentylene glycol, hexylene glycol, heptylene glycol, octylene glycol, nonylene glycol, and decylene glycol.

A homopolymer or a copolymer of an alkylene oxide, such as ethylene oxide, propylene oxide, and butylene oxide is used as a polyoxyalkylene glycol. It should be noted that, when a polyoxyalkylene glycol includes copolymerized alkylene oxides with different structures, the format of polymerization of oxyalkylene groups is not particularly limited, and may be polymerized by a random copolymerization or a block copolymerization.

Furthermore, examples of polyoxyalkylene alkyl ethers include an alkyl ether of the above-mentioned polyoxyalkylene glycol. In this case, a polyoxyalkylene glycol is preferably a polymer of ethylene oxide and/or propylene oxide in terms of stability (for example, two-layer separation) of the rust preventive composition of the present application. Furthermore, the average degree of polymerization is preferably 2 to 15, more preferably 2 to 10, and even more preferably 2 to 7 for similar reasons. Furthermore, the carbon number of the alkyl group of the alkyl ether is preferably 1 to 24, more preferably 2 to 24, even more preferably 2 to 20, and most preferably 2 to 18 for similar reasons.

Furthermore, examples of polyoxyalkylene aryl ethers include a phenyl ether and an alkylphenyl ether of the above-mentioned polyoxyalkylene glycol. In this case, a polyoxyalkylene glycol is preferably a polymer of ethylene oxide and/or propylene oxide in terms of stability (for example, two-layer separation) of the rust preventive composition. Furthermore, the average degree of polymerization is preferably 2 to 15, more preferably 2 to 10, and even more preferably 2 to 7 for similar reasons. Furthermore, the carbon number of the alkyl group of an alkylphenyl ether is preferably 1 to 24, more preferably 4 to 24, even more preferably 6 to 22, and most preferably 8 to 20 for similar reasons.

Furthermore, polyoxyalkylene alkylamines include a polyalkylene oxide adduct of an alkylamine.

In this case, a polyalkylene oxide is preferably a polymer of ethylene oxide and/or propylene oxide in terms of the rust preventive effect of the rust preventive composition. Furthermore, the average degree of polymerization of a poly alkylene oxide is preferably 1 to 15, more preferably 1 to 10, and even more preferably 2 to 7 for similar reasons. Among these, polyalkylene oxide adducts of a monoalkylamine, a dialkylamine, a monocycloalkyl amine, and a dicycloalkylamine are preferred, and a polyalkylene oxide adduct of a monocyclohexylamine is particularly preferred.

It should be noted that one of the above-mentioned nonionic surfactants may be used alone, or two or more of the surfactants may be used together. Although the detergent composition of the present invention may not include a nonionic surfactant, when it includes a nonionic surfactant, the preferable content is 0.01 to 10% by mass based on the total mass of the composition. The upper limit of the content is preferably 10% by mass or less, more preferably 8% by mass or less, even more preferably 6% by mass or less, and most preferably 5% by mass or less in terms of the rust preventive effect.

Preferable examples of sulfonate salts used in the present invention include alkali metal sulfonates, alkaline earth metal sulfonates, and amine sulfonates. All the sulfonate salts have a satisfactorily high safety for the human body and the ecosystem and can be produced by reacting an alkali metal, an alkaline earth metal, or an amine with sulfonic acid.

Examples of alkali metals that constitute sulfonate salts include sodium and potassium. Meanwhile, examples of alkaline earth metals include magnesium, calcium, and barium. Among these alkali metals and alkaline earth metals, sodium, potassium, calcium, and barium are preferred, and particularly calcium is preferred.

When the sulfonate salt is an amine salt, examples of amines to be used include a monoamine, a polyamine, and an alkanolamine.

Examples of monoamines include the following: alkylamines, such as monomethylamine, dimethylamine, trimethylamine, monoethylamine, diethylamine, triethylamine, monopropylamine, dipropylamine, tripropylamine, monobutylamine, dibutylamine, tributylamine, monopentylamine, dipentylamine, tripentylamine, monohexylamine, dihexylamine, monoheptylamine, diheptylamine, monooctylamine, dioctylamine, monononylamine, monodecylamine, monoundecylamine, monododecylamine, monotridecylamine, monotetradecylamine, monopentadecylamine, monohexadecylamine, monoheptadecylamine, monooctadecylamine, monononadecylamine, monoicosylamine, monohenicosylamine, monodocosylamine, monotricosylamine, dimethyl(ethyl)amine, dimethyl(propyl)amine, dimethyl(butyl)amine, dimethyl(pentyl)amine, dimethyl(hexyl)amine, dimethyl(heptyl)amine, dimethyl(octyl)amine, dimethyl(nonyl)amine, dimethyl(decyl)amine, dimethyl(undecyl)amine, dimethyl(dodecyl)amine, dimethyl(tridecyl)amine, dimethyl(tetradecyl)amine, dimethyl(pentadecyl)amine, dimethyl(hexadecyl)amine, dimethyl(heptadecyl)amine, dimethyl(octadecyl)amine, dimethyl(nonadecyl)amine, dimethyl(icosyl)amine, dimethyl(henicosyl)amine, and dimethyl(tricosyl)amine; alkenyl amines, such as monovinylamine, divinylamine, trivinylamine, monopropenylamine, dipropenylamine, tripropenylamine, monobutenylamine, dibutenylamine, tributenylamine, monopentenylamine, dipentenylamine, tripentenylamine, monohexenylamine, dihexenylamine, monoheptenylamine, diheptenylamine, monooctenylamine, dioctenylamine, monononenylamine, monodecenylamine, monoundecenylamine, monododecenylamine, monotridecenylamine, monotetradecenylamine, monopentadecenylamine, monohexadecenylamine, monoheptadecenylamine, monooctadecenylamine, mononondecenylamine, monoicosenylamine, monohenicosenylamine, monodocosenylamine, and monotricosenylamine; monoamines having an alkyl group and an alkenyl group, such as dimethyl(vinyl)amine, dimethyl(propenyl)amine, dimethyl(butenyl)amine, dimethyl(pentenyl)amine, dimethyl(hexenyl)amine, dimethyl(heptenyl)amine, dimethyl(octenyl)amine, dimethyl(nonenyl)amine, dimethyl(decenyl)amine, dimethyl(undecenyl)amine, dimethyl(dodecenyl)amine, dimethyl(tridecenyl)amine, dimethyl(tetradecenyl)amine, dimethyl(pentadecenyl)amine, dimethyl(hexadecenyl)amine, dimethyl(heptadecenyl)amine, dimethyl(octadecenyl)amine, dimethyl(nonadecenyl)amine, dimethyl(icosenyl)amine, dimethyl(henicosenyl)amine, and dimethyl(tricosenyl)amine; aromatic-substituted alkylamines, such as monobenzylamine, (1-phenethyl)amine, (2-phenethyl)amine (also called monophenethylamine), dibenzylamine, bis(1-phenethyl)amine, and bis(2-phenethyl)amine (also called diphenethylamine); cycloalkylamines having 5 to 16 carbon atoms, such as monocyclopentylamine, dicyclopentylamine, tricyclopentylamine, monocyclohexylamine, dicyclohexylamine, monocycloheptylamine, and dicycloheptylamine; monoamines having an alkyl group and a cycloalkyl group, such as dimethyl(cyclopentyl)amine, dimethyl(cyclohexyl)amine, and dimethyl(cycloheptyl)amine; alkylcycloalkylamines, such as (methylcyclopentyl)amine, bis(methylcyclopentyl)amine, (dimethylcyclopentyl)amine, bis(dimethylcyclopentyl)amine, (ethylcyclopentyl)amine, bis(ethylcyclopentyl)amine, (methylethylcyclopentyl)amine, bis(methylethylcyclopentyl)amine, (diethylcyclopentyl)amine, (methylcyclohexyl)amine, bis(methylcyclohexyl)amine, (dimethylcyclohexyl)amine, bis(dimethylcyclohexyl)amine, (ethylcyclohexyl)amine, bis(ethylcyclohexyl)amine, (methylethylcyclohexyl)amine, (diethylcyclohexyl)amine, (methylcycloheptyl)amine, bis(methylcycloheptyl)amine, (dimethylcycloheptyl)amine, (ethylcycloheptyl)amine, (methylethylcycloheptyl)amine, and (diethylcycloheptyl)amine; and all the substituted isomers of these monoamines. Monoamines herein include monoamines such as a beef tallow amine derived from fats and oils.

Examples of polyamines include the following: alkylenepolyamines, such as ethylenediamine, diethylenetriamine, triethylenetetramine, tetraethylenepentamine, pentaethylenehexamine, propylenediamine, dipropylenetriamine, tripropylenetetramine, tetrapropylenepentamine, pent apropylenehexamine, butylenediamine, dibutylenetriamine, tributylenetetramine, tetrabutylenepentamine, and pent abutylenehexamine; N-alkylethylenediamines, such as N-methylethylenediamine, N-ethylethylenediamine, N-propylethylenediamine, N-butylethylenediamine, N-pentylethylenediamine, N-hexylethylenediamine, N-heptylethylenediamine, N-octylethylenediamine, N-nonylethylenediamine, N-decylethylenediamine, N-undecylethylenediamine, N-dodecylethylenediamine, N-tridecylethylenediamine, N-tetradecylethylenediamine, N-pentadecylethylenediamine, N-hexadecylethylenediamine, N-heptadecylethylenediamine, N-octadecylethylenediamine, N-nonadecylethylenediamine, N-icosylethylenediamine, N-henicosylethylenediamine, N-docosylethylenediamine, and N-tricosylethylenediamine; N-alkenylethylenediamines, such as N-vinylethylenediamine, N-propenylethylenediamine, N-butenylethylenediamine, N-pentenylethylenediamine, N-hexenylethylenediamine, N-heptenylethylenediamine, N-octenylethylenediamine, N-nonenylethylenediamine, N-decenylethylenediamine, N-undecenylethylenediamine, N-dodecenylethylenediamine, N-tridecenylethylenediamine, N-tetradecenylethylenediamine, N-pentadecenylethylenediamine, N-hexadecenylethylenediamine, N-heptadecenylethylenediamine, N-octadecenylethylenediamine, N-nonadecenylethylenediamine, N-icosenylethylenediamine, N-henicosenylethylenediamine, N-docosenylethylenediamine, and N-tricosenylethylenediamine; and N-alkylalkylenepolyamines or N-alkenylalkylenepolyamines, such as N-alkyldiethylenetriamine, N-alkenyldiethylenetriamine, N-alkyltriethylenetetramine, N-alkenyltriethylenetetramine, N-alkyltetraethylenepentamine, N-alkenyltetraethylenepentamine, N-alkylpentaethylenehexamine, N-alkenylpentaethylenehexamine, N-alkylpropylenediamine, N-alkenylpropylenediamine, N-alkyldipropylenetriamine, N-alkenyldipropylenetriamine, N-alkyltripropylenetetramine, N-alkenyltripropylenetetramine, N-alkyltetrapropylenepentamine, N-alkenyltetrapropylenepentamine, N-alkylpentapropylenehexamine, N-alkenylpentapropylenehexamine, N-alkylbutylenediamine, N-alkenylbutylenediamine, N-alkyldibutylenetriamine, N-alkenyldibutylenetriamine, N-alkyltributylenetetramine, N-alkenyltributylenetetramine, N-alkyltetrabutylenepentamine, N-alkenyltetrabutylenepentamine, N-alkylpentabutylenehexamine, and N-alkenylpentabutylenehexamine; and all the substituted isomers of these polyamines. Also, polyamines herein include polyamines derived from fats and oils (for example, a beef tallow polyamine).

Examples of alkanolamines include monomethanolamine, dimethanolamine, trimethanolamine, monoethanolamine, diethanolamine, triethanolamine, mono(n-propanol)amine, di(n-propanol)amine, tri(n-propanol)amine, monoisopropanolamine, diisopropanolamine, triisopropanolamine, monobutanolamine, dibutanolamine, tributanolamine, monopentanolamine, dipentanolamine, tripentanolamine, monohexanolamine, dihexanolamine, monoheptanolamine, diheptanolamine, monooctanolamine, mononononanolamine, monodecanolamine, monoundecanolamine, monododecanolamine, monotridecanolamine, monotetradecanolamine, monopentadecanolamine, monohexadecanolamine, diethylmonoethanolamine, diethylmonopropanolamine, diethylmonobutanolamine, diethylmonopentanolamine, dipropylmonoethanolamine, dipropylmonopropanolamine, dipropylmonobutanolamine, dipropylmonopentanolamine, dibutylmonoethanolamine, dibutylmonopropanolamine, dibutylmonobutanolamine, dibutylmonopentanolamine, monoethyldiethanolamine, monoethyldipropanolamine, monoethyldibutanolamine, monoethyldipentanolamine, monopropyldiethanolamine, monopropyldipropanolamine, monopropyldibutanolamine, monopropyldipentanolamine, monobutyldiethanolamine, monobutyldipropanolamine, monobutyldibutanolamine, monobutyldipentanolamine, monocyclohexylmonoethanolamine, monocyclohexyldiethanolamine, monocyclohexylmonopropanolamine, monocyclohexyldipropanolamine; and all the substituted isomers of these alkanolamines.

The above-mentioned sulfonic acid may be a known sulfonic acid produced by a routine method. Specific examples include petroleum sulfonic acids, such as that produced by sulfonating an alkylaromatic compound, which is generally a lubricating oil distillate of a mineral oil, and so-called mahogany acid, which is a byproduct of manufacturing white oil; and synthetic sulfonic acids, such as that produced by sulfonating an alkylbenzene having a linear or branched alkyl group and that produced by sulfonating an alkylnaphthalene such as dinonylnaphthalene. Herein, the alkylbenzene is obtained by alkylating benzene using a polyolefin byproduct from a manufacturing plant of alkylbenzene, which is used as a raw material of detergents.

Among the above-mentioned sulfonic acids, it is preferable to use at least one selected from the group consisting of dialkylnaphthalene sulfonic acids in which the total carbon number of the two alkyl groups bound to a naphthalene ring is 14 to 30; dialkylbenzene sulfonic acids in which the two alkyl groups bound to a benzene ring are independently a linear alkyl group or a branched alkyl group having one methyl group as a side chain, and the total carbon number of the two alkyl groups is 14 to 30; and monoalkylbenzene sulfonic acids in which the carbon number of the alkyl group bound to a benzene ring is 15 or more.

Concerning the above-mentioned preferable dialkylnaphthalene sulfonic acid in which the total carbon number of the two alkyl groups bound to a naphthalene ring is 14 to 30, when the total carbon number of the two alkyl groups is less than 14, the demulsibility tends to be insufficient. On the other hand, when the total carbon number is more than 30, the storage stability of the rust preventive oil composition obtained tends to be deteriorated. The two alkyl groups may be independently linear or branched. Additionally, the carbon number of each alkyl group is not particularly limited as long as the total carbon number of the two alkyl groups is 14 to 30; however, preferably, the carbon number of each alkyl group is independently 6 to 18.

The above-mentioned preferable dialkylbenzene sulfonic acid is one in which the two alkyl groups bound to a benzene ring are independently a linear alkyl group or a branched alkyl group having one methyl group as a side chain, and the total carbon number of the two alkyl groups is 14 to 30. In the case of a monoalkylbenzene sulfonic acid, as described below, the monoalkylbenzene sulfonic acid in which the carbon number of the alkyl group therein is 15 or more can be preferably used; however, when the monoalkylbenzene sulfonic acid in which the carbon number of the alkyl group is less than 15 is used, the storage stability of the composition tends to be deteriorated. Also, the use of an alkylbenzene sulfonic acid having three or more alkyl groups tends to decrease the storage stability of the composition.

When the alkyl group bound to a benzene ring in a dialkylbenzene sulfonic acid is a branched alkyl group that has a branched structure having a group other than a methyl group as a side chain, for example, a branched alkyl group having an ethyl group as a side chain, or a branched alkyl group that has two or more branched structures, for example, a branched alkyl group derived from a propylene oligomer, there is a possibility that the human body or the ecosystem is adversely affected, and the rust preventive effect tends to be insufficient. Furthermore, when the total carbon number of the two alkyl groups bound to a benzene ring in a dialkylbenzene sulfonic acid is less than 14, the demulsibility tends to decrease. On the other hand, when the total number is more than 30, the storage stability of the composition tends to decrease. Additionally, the carbon number of each alkyl group is not particularly limited as long as the total carbon number of the two alkyl groups bound to a benzene ring is 14 to 30; however, preferably, the carbon number of each alkyl group is independently 6 to 18.

The above-mentioned preferable monoalkylbenzene sulfonic acid is one in which the carbon number of the one alkyl group bound to a benzene ring is 15 or more, as described above. When the carbon number of the alkyl group bound to a benzene ring is less than 15, the storage stability of the composition obtained tends to decrease. Additionally, the alkyl group bound to a benzene ring may be linear or branched, as long as the carbon number is 15 or more.

Examples of sulfonate salts obtained by using the above-mentioned raw materials include the following: a neutral sulfonate (normal salt) obtained by reacting an alkali metal base such as an oxide or hydroxide of an alkali metal, an alkaline earth metal base such as an oxide or hydroxide of an alkaline earth metal, or ammonia, or an amine such as an alkylamine and an alkanolamine with sulfonic acid; a basic sulfonate obtained by heating the above neutral sulfonate (normal salt) and an excessive amount of an alkali metal base, an alkaline earth metal base, or an amine in the presence of water; a carbonate overbased (ultrabasic) sulfonate obtained by reacting the above neutral sulfonate (normal salt) with an alkali metal base, an alkaline earth metal base, or an amine in the presence of carbon dioxide; a borate overbased (ultrabasic) sulfonate obtained by reacting the above neutral sulfonate (normal salt) with an alkali metal base, an alkaline earth metal base, or an amine and a boric acid compound such as boric acid or anhydrous boric acid, alternatively by reacting the above carbonate overbased (ultrabasic) sulfonate with a boric acid compound such as boric acid or anhydrous boric acid; and mixtures thereof.

When the above-mentioned neutral sulfonate (normal salt) is produced, the sulfonate salt of interest can also be obtained by adding as an accelerant a chloride of an alkali metal, an alkaline earth metal, or an amine that is the same species as that whose sulfonate salt is of interest, or by performing an exchange reaction. In the exchange reaction, a neutral sulfonate (normal salt) of an alkali metal, an alkaline earth metal, or an amine that is a different species from that whose sulfonate salt is of interest is prepared, then a chloride of an alkali metal, an alkaline earth metal, or an amine that is the same species as that whose sulfonate salt is of interest is added. However, the sulfonate salts obtained by such methods tend to have remaining chloride ions. Therefore, in the present invention, it is preferable not to use the sulfonate salts obtained by such methods or to apply a thorough rinse such as water washing to the sulfonate salts obtained. Specifically, the chlorine concentration in a sulfonate salt is preferably 200 ppm by mass or less, more preferably 100 ppm by mass or less, even more preferably 50 ppm by mass or less, and particularly preferably 25 ppm by mass or less.

Additionally, it is preferable to use as a sulfonate salt at least one selected from the group consisting of: dialkylnaphthalene sulfonate salts in which the total carbon number of the two alkyl groups bound to a naphthalene ring is 14 to 30; dialkylbenzene sulfonate salts in which the two alkyl groups bound to a benzene ring are independently a linear alkyl group or a branched alkyl group having one methyl group as a side chain, and the total carbon number of the two alkyl groups is 14 to 30; and monoalkylbenzene sulfonate salts in which the carbon number of the alkyl bound to a benzene ring is 15 or more.

In the present invention, it is more preferable to use one or more sulfonate salts selected from neutral, basic, or overbased alkali metal sulfonates and alkaline earth metal sulfonates among those described above. It is particularly preferable to use neutral or near neutral alkali metal sulfonates or alkaline earth metal sulfonates wherein a base number is 0 to 50 mgKOH/g, and preferably 10 to 30 mgKOH/g, and/or (overbased) basic alkali metal sulfonates or alkaline earth metal sulfonates wherein a base number is 50 to 500 mgKOH/g, and preferably 200 to 400 mgKOH/g. Additionally, the mass ratio of the alkali metal sulfonate or alkaline earth metal sulfonate wherein a base number is 0 to 50 mgKOH/g to the alkali metal sulfonate or alkaline earth metal sulfonate wherein a base number is 50 to 500 mgKOH/g ((alkali metal sulfonate or alkaline earth metal sulfonate wherein a base number is 0 to 50 mgKOH/g)/(alkali metal sulfonate or alkaline earth metal sulfonate wherein a base number is 50 to 500 mgKOH/g)) is preferably 0.1 to 30, more preferably 1 to 20, and particularly preferably 1.5 to 15 based on the total mass of the composition.

As used herein, "base number" means a base number determined by the hydrochloric acid method in accordance with JIS K 2501 "Petroleum products and lubricants—Determination of neutralization number", Section 6, wherein the subject usually includes 30 to 70% by mass of a diluent such as a base oil of a lubricating oil.

Among the sulfonate salts used in the present invention, an amine sulfonate, calcium sulfonate, and barium sulfonate are preferred, and an alkylene diamine sulfonate and calcium sulfonate are particularly preferred.

Examples of the above-mentioned esters used as a rust preventive component include a partial ester of a polyalcohol, esterified oxidized wax, esterified lanolin fatty acid, and an alkyl succinate ester or an alkenyl succinate ester.

"A partial ester of a polyalcohol" means an ester in which at least one of the hydroxyl groups in the polyalcohol is not esterified and remains as a hydroxyl group. Although any polyalcohol may be used as a raw material, a polyalcohol that has preferably 2 to 10, and more preferably 3 to 6 hydroxyl groups in the molecule and has 2 to 20, and more preferably 3 to 10 carbon atoms is preferably used. Among these polyalcohols, it is preferable to use at least one polyalcohol selected from the group consisting of glycerol, trimethylolethane, trimethylolpropane, pentaerythritol, and sorbitan, and it is more preferable to use pentaerythritol.

Meanwhile, although any carboxylic acid may be used as a component of a partial ester, the carboxylic acid has preferably 2 to 30, more preferably 6 to 24, and even more preferably 10 to 22 carbon atoms. Furthermore, the carboxylic acid may be a saturated carboxylic acid or an unsaturated carboxylic acid, and a linear carboxylic acid or a branched carboxylic acid. Examples of such fatty acids include saturated fatty acids, such as acetic acid, propionic acid, butanoic acid, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, henicosanoic acid, docosanoic acid, tricosanoic acid, tetracosanoic acid, pentacosanoic acid, hexacosanoic acid, heptacosanoic acid, octacosanoic acid, nonacosanoic acid, and triacontanoic acid; unsaturated fatty acids, such as propenoic acid, butenoic acid, pentenoic acid, hexenoic acid, heptenoic acid, octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecenoic acid, nonadecenoic acid, icosenoic acid, henicosenoic acid, docosenoic acid, tricosenoic acid, tetracosenoic acid, pentacosenoic acid, hexacosenoic acid, heptacosenoic acid, octacosenoic acid, nonacosenoic acid, and triacontenoic acid; mixtures thereof; and all the substituted isomers of these fatty acids.

A hydroxycarboxylic acid may be used as a carboxylic acid that constitutes a partial ester. Although the hydroxycarboxylic acid may be a saturated carboxylic acid or an unsaturated carboxylic acid, a saturated carboxylic acid is preferred in terms of stability. Furthermore, the hydroxycarboxylic acid may be a linear carboxylic acid or a branched carboxylic acid; however, a linear carboxylic acid or a branched carboxylic acid that has 1 to 3, more preferably 1 to 2, and particularly preferably one branched chain is preferred, wherein the branched chain is one with a carbon number of 1 or 2, and more preferably one with a carbon number of 1 (i.e., a methyl group).

The carbon number of a hydroxycarboxylic acid is preferably 2 to 40, more preferably 6 to 30, and even more preferably 8 to 24 to provide both a good rust preventive effect and storage stability. The number of the carboxylic acid groups in a hydroxycarboxylic acid is not particularly limited, and the hydroxycarboxylic acid may be either a monobasic acid or a polybasic acid; however, a monobasic acid is preferred. Although the number of the hydroxyl groups in a hydroxycarboxylic acid is not particularly limited, the number is preferably 1 to 4, more preferably 1 to 3, even more preferably 1 to 2, and particularly preferably 1 in terms of stability.

A hydroxyl group may be bound to a hydroxycarboxylic acid at any position; however, a carboxylic acid in which a hydroxyl group is bound to the carbon atom to which a carboxylic acid group is bound (alpha-hydroxy acid) or a carboxylic acid in which a hydroxyl group is bound to a carbon atom at the other end of the backbone when viewed from the carbon atom to which a carboxylic acid group is bound (omega-hydroxy acid) is preferred.

Preferable examples of hydroxycarboxylic acids include an alpha-hydroxy acid represented by formula (1) and an omega-hydroxy acid represented by formula (2):

[Chem. 1]

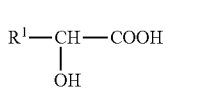

(1)

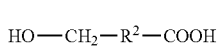

(2)

in which $R^1$ represents a hydrogen atom, an alkyl group with a carbon number of 1 to 38, or an alkenyl group with a carbon number of 2 to 38;

$R^2$ represents an alkylene group with a carbon number of 1 to 38 or an alkenylene group with a carbon number of 2 to 38.

Examples of alkyl groups and alkenyl groups represented by $R^1$ include alkyl groups, such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an icosyl group, a henicosyl group, a docosyl group, a tricosyl group, a tetracosyl group, a pentacosyl group, a hexacosyl group, a heptacosyl group, an octacosyl group, a nonacosyl group, a triacontyl group, a hentriacontyl group, a dotriacontyl group, a tritriacontyl group, a tetratriacontyl group, a pentatriacontyl group, a hexatriacontyl group, a heptatriacontyl group, an octatriacontyl group; alkenyl groups, such as an ethenyl group (vinyl group), a propenyl group (allyl group), a butenyl group, a pentenyl group, a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an icosenyl group, a henicosenyl group, a docosenyl group, a tricosenyl group, a tetracosenyl group, a pentacosenyl group, a hexacosenyl group, a heptacosenyl group, an octacosenyl group, a nonacosenyl group, a triacontenyl group, a hentriacontenyl group, a dotriacontenyl group, a tritriacontenyl group, a tetratriacontenyl group, a pentatriacontenyl group, a hexatriacontenyl group, a heptatriacontenyl group, and an octatriacontenyl group; and all the isomers thereof.

Examples of alkylene groups and alkenylene groups represented by $R^2$ include alkylene groups, such as a methylene group, an ethylene group, a propylene group, a butylene group, a pentylene group, a hexylene group, a heptylene group, an octylene group, a nonylene group, a decylene group, an undecylene group, a dodecylene group, a tridecylene group, a tetradecylene group, a pentadecylene group, a hexadecylene group, a heptadecylene group, an octadecylene group, a nonadecylene group, an icosylene group, a henicosylene group, a docosylene group, a tricosylene group, a tetracosylene group, a pentacosylene group, a hexacosylene group, a heptacosylene group, an octacosylene group, a nonacosylene group, a triacontylene group, a hentriacontylene group, a dotriacontylene group, a tritriacontylene group, a tetratriacontylene group, a pentatriacontylene group, a hexatriacontylene group, a heptatriacontylene group, and an octatriacontylene group; alkenylene groups, such as an ethenylene group (vinylene group), a propenyl group (allylene group), a butenylene group, a pentenylene group, a hexenylene group, a heptenylene group, an octenylene group, a nonenylene group, a decenylene group, an undecenylene group, a dodecenylene group, a tridecenylene group, a tetradecenylene group, a pentadecenylene group, a hexadecenylene group, a heptadecenylene group, an octadecenylene group, a nonadecenylene group, an icosenylene group, a henicosenylene group, a docosenylene group, a tricosenylene group, a tetracosenylene group, a pentacosenylene group, a hexacosenylene group, a heptacosenylene group, an octacosenylene group, a nonacosenylene group, a triacontenylene group, a hentriacontenylene group, a dotriacontenylene group, a tritriacontenylene group, a tetratriacontenylene group, a pentatriacontenylene group, a hexatriacontenylene group, a heptatriacontenylene group, and an octatriacontenylene group; and all the isomers thereof.

Lanolin fatty acid, which is obtained by refining a waxy material that adheres to wool, for example, by hydrolysis, may be preferably used as a raw material that includes such hydroxycarboxylic acid. When a hydroxycarboxylic acid is used as a carboxylic acid component of a partial ester, a carboxylic acid with no hydroxyl group may be used in combination. When carboxylic acid components of a partial ester include both a hydroxycarboxylic acid and a carboxylic acid with no hydroxyl group, the percentage of hydroxycarboxylic acid relative to the total carboxylic acid components is preferably 5 to 80% by mass. When the percentage of the hydroxycarboxylic acid is less than 5% by mass, the rust preventive effect tends to be insufficient. The percentage of the hydroxycarboxylic acid is more preferably 10% by mass or more, and even more preferably 15% by mass or more for similar reasons. On the other hand, when the percentage of the hydroxycarboxylic acid is more than 80% by mass, the storage stability and solubility in the base oil tend to be insufficient. The percentage of the hydroxycarboxylic acid is more preferably 60% by mass or less, even more preferably 40% by mass or less, still more preferably 30% by mass or less, and particularly preferably 20% by mass or less for similar reasons.

A carboxylic acid with no hydroxyl group may be a saturated carboxylic acid or an unsaturated carboxylic acid. Among carboxylic acids with no hydroxyl group, a saturated carboxylic acid may be a linear carboxylic acid or a branched carboxylic acid; however, a linear carboxylic acid or a branched carboxylic acid that has 1 to 3, more preferably 1 to 2, and even more preferably one branched chain is preferred, wherein the branched chain is one with a carbon number of 1 or 2, and more preferably one with a carbon number of 1 (i.e., a methyl group).

The carbon number of a saturated carboxylic acid with no hydroxyl group is preferably 2 to 40, more preferably 6 to 30, and even more preferably 8 to 24 to provide both a good rust preventive effect and storage stability. The number of the carboxylic acid groups in a saturated carboxylic acid with no hydroxyl group is not particularly limited, and the saturated carboxylic acid may be either a monobasic acid or a polybasic acid; however a monobasic acid is preferred. Among saturated carboxylic acids with no hydroxyl group, a linear saturated carboxylic acid having 10 to 16 carbon atoms, such as lauric acid and stearic acid is particularly preferred in terms of oxidation stability and stain resistance.

Among carboxylic acids with no hydroxyl group, an unsaturated carboxylic acid may be either a linear carboxylic acid or a branched carboxylic acid; however, a linear carboxylic acid or a branched carboxylic acid that has 1 to 3, more preferably 1 to 2, and even more preferably one branched chain is preferred, wherein the branched chain is one with a carbon number of 1 or 2, and more preferably one with a carbon number of 1. Regarding carboxylic acids with no hydroxyl group, the carbon number of an unsaturated carboxylic acid is preferably 2 to 40, more preferably 6 to 30, even more preferably 8 to 24, and particularly preferably 12 to 22 to provide both a good rust preventive effect and storage stability.

The number of the carboxylic acid groups in an unsaturated carboxylic acid with no hydroxyl group is not particularly limited, and the unsaturated carboxylic acid may be either a monobasic acid or a polybasic acid; however a monobasic acid is preferred. Although the number of unsaturated bonds in an unsaturated carboxylic acid with no hydroxyl group is not particularly limited, the number is preferably 1 to 4, more preferably 1 to 3, even more preferably 1 to 2, and particularly preferably 1 in terms of stability. Among unsaturated carboxylic acids with no hydroxyl group, a linear unsaturated carboxylic acid having 18 to 22 carbon atoms such as oleic acid is preferred in terms of the rust preventive effect and solubility in the base oil. A branched unsaturated carboxylic acid having 18 to 22 carbon atoms such as isostearic acid is preferred in terms of oxidation stability, solubility in the base oil, and stain resistance. In particular, oleic acid is preferred.

In a partial ester of a polyalcohol and a carboxylic acid, the percentage of an unsaturated carboxylic acid relative to the total carboxylic acid components is preferably 5 to 95% by mass. By increasing the percentage of the unsaturated carboxylic acid to 5% by mass or more, the rust preventive effect and storage stability can be enhanced further. The percentage of the unsaturated carboxylic acid is more preferably 10% by mass, or more even more preferably 20% by mass or more, still more preferably 30% by mass or more, and particularly preferably 35% by mass or more for similar reasons. Meanwhile, when the percentage of the unsaturated carboxylic acid is more than 95% by mass, resistance to atmospheric exposure and solubility in the base oil tend to be insufficient. The percentage of the unsaturated carboxylic acid is more preferably 80% by mass or less, even more preferably 60% by mass or less, and particularly preferably 50% by mass or less for similar reasons.

Unsaturated carboxylic acids include both an unsaturated carboxylic acid with a hydroxyl group and an unsaturated carboxylic acid with no hydroxyl group. The percentage of the unsaturated carboxylic acid with no hydroxyl group relative to the total unsaturated carboxylic acid is preferably 80% by mass or more, more preferably 90% by mass or more, and even more preferably 95% by mass or more.

When the above-mentioned partial ester is a partial ester in which the percentage of the unsaturated carboxylic acid relative to the carboxylic acid components is 5 to 95% by mass, the iodine value of the partial ester is preferably 5 to 75, more preferably 10 to 60, and even more preferably 20 to 45. When the iodine value of the partial ester is less than 5, the rust preventive effect and storage stability tend to decrease. On the other hand, when the iodine value of the partial ester is more than 75, resistance to atmospheric exposure and solubility in the base oil tend to decrease. The term "iodine value" used in the present invention means an iodine value determined by the indicator titration method in accordance with JIS K 0070 "Acid value, saponification value, iodine value, hydroxyl value and unsaponification value of chemical products".

Examples of methods for producing the above-mentioned partial esters include production methods (i), (ii), and (iii) described below:

(i) a method by mixing a partial ester of a polyalcohol and a hydroxycarboxylic acid or a mixture of a hydroxycarboxylic acid and a saturated carboxylic acid with no hydroxyl group with a partial ester of a polyalcohol and an unsaturated carboxylic acid with no hydroxyl group or a mixture of an unsaturated carboxylic acid with no hydroxyl group and a saturated carboxylic acid with no hydroxyl group, so that the composition of carboxylic acids in the mixture including both partial esters meets the above conditions;

(ii) a method by mixing a carboxylic acid with a hydroxyl group and an unsaturated carboxylic acid with no hydroxyl group or alternatively adding a saturated carboxylic acid with no hydroxyl group additionally, and carrying out a partial esterification reaction between the mixture of the carboxylic acids and a polyalcohol, so that the composition of carboxylic acids in the resultant partial ester meets the above conditions;

(iii) a method by adding a partial ester of a polyalcohol and a hydroxycarboxylic acid or a mixture of a hydroxycarboxylic acid and a saturated carboxylic acid with no hydroxyl group, or a partial ester of a polyalcohol and an unsaturated carboxylic acid with no hydroxyl group or a mixture of an unsaturated carboxylic acid with no hydroxyl group and a saturated carboxylic acid with no hydroxyl group to a partial ester of a mixture of a hydroxycarboxylic acid and an unsaturated carboxylic acid with no hydroxyl group or a mixture of these carboxylic acids and a saturated carboxylic acid with no hydroxyl group, so that the composition of carboxylic acids meets the above conditions.

In the production method (i), for example, lanolin fatty acid and an unsaturated carboxylic acid with a carbon number of 2 to 40 such as oleic acid may be preferably used as a mixture of a hydroxycarboxylic acid and a saturated carboxylic acid with no hydroxyl group and as an unsaturated carboxylic acid with no hydroxyl group, respectively. In this case, the contents of the partial ester (a first partial ester) composed of a polyalcohol and a mixture of a hydroxycarboxylic acid and a saturated carboxylic acid with no hydroxyl group, preferably lanolin fatty acid and the partial ester (a second partial ester) composed of a polyalcohol and an unsaturated carboxylic acid with no hydroxyl group, preferably oleic acid are not particularly limited as long as the composition ratio of carboxylic acids in the mixture including both partial esters meets the above conditions. However, the percentage of the first partial ester is preferably 20 to 95% by mass, more preferably 40 to 80% by mass, and particularly preferably 55 to 65% by mass relative to the total amount of the first partial ester and the second partial ester. When the percentage of the first partial ester is less than 20% by mass or more than 95% by mass, the rust preventive effect such as resistance to atmospheric exposure tends to be insufficient. Furthermore, when the percentage of the first partial ester is more than 95% by mass, the solubility of the whole partial ester in the base oil decreases and storage stability tends to be insufficient.

The above-mentioned esterified oxidized wax is a wax produced by reacting oxidized wax with alcohols, thereby esterifying some or all of the acidic groups in the oxidized wax. Examples of oxidized waxes that are used as a raw material for esterified oxidized wax include oxidized wax. Examples of alcohols that are used as a raw material for esterified oxidized wax include a linear or branched saturated monohydric alcohol having 1 to 20 carbon atoms, a linear or branched unsaturated monohydric alcohol having 1 to 20 carbon atoms, a polyalcohol exemplified in the description of the above esters, and an alcohol produced by hydrolysis of lanolin.

The above-mentioned esterified lanolin fatty acid is obtained by reacting lanolin fatty acid, which is obtained by refining a waxy material that adheres to wool, for example, by hydrolysis, with alcohol. Alcohols used as a raw material for esterified lanolin fatty acid include the alcohols exemplified in the description of the above esterified oxidized wax. Among them, polyalcohols are preferred, and trimethylolpropane, trimethylolethane, sorbitan, pentaerythritol, and glycerol are more preferred. The above-mentioned alkyl succinate esters or alkenyl succinate esters include esters of the above-mentioned alkyl succinic acid or alkenyl succinic acid and a monohydric alcohol or a dihydric or higher polyalcohol. Among these, esters of a monohydric alcohol or a dihydric alcohol are preferred.

The monohydric alcohol may be linear or branched, and may also be a saturated alcohol or an unsaturated alcohol. Furthermore, although the carbon number of the monohydric alcohol is not particularly limited, an aliphatic alcohol with a carbon number of 8 to 18 is preferred. Preferably, an alkylene glycol and a polyoxyalkylene glycol are used as a dihydric alcohol. Examples of alkylene glycols include ethylene glycol, propylene glycol, butylene glycol, pentylene glycol, hexylene glycol, heptylene glycol, octylene glycol, nonylene glycol, and decylene glycol.

Examples of polyoxyalkylene glycols include a homopolymer or a copolymer of ethylene oxide, propylene oxide, and butylene oxide. When a polyoxyalkylene glycol is a copolymer composed of structurally different alkylene oxides, there is no particular limitation to how the oxyalkylene groups polymerize, and the polyoxyalkylene glycol may be either a random copolymer or a block copolymer. Furthermore, although the degree of polymerization of the polyoxyalkylene glycol is not particularly limited, it is preferably 2 to 10, more preferably 2 to 8, and even more preferably 2 to 6.

The alkyl succinate ester or alkenyl succinate ester may be a diester (complete ester) in which both of the two carboxyl groups in an alkyl succinic acid or an alkenyl succinic acid are esterified, or a monoester (partial ester) in which either one of the carboxyl groups is esterified. Monoesters are preferred due to a better rust preventive effect. Among these esters, the use of a partial ester of a polyalcohol is particularly preferred since the partial ester exhibits a better rust preventive effect. Specific examples include pentaerythritol ester of lanolin, sorbitan monoolate, and sorbitan isostearate.

The above-mentioned amines used as a rust preventive component include the amines exemplified in the description of the above-mentioned sulfonate salts.

Among the amines, monoamines are preferred due to good stain resistance. Among monoamines, an alkyl amine, a monoamine having an alkyl group and an alkenyl group, a monoamine having an alkyl group and a cycloalkyl group, a cycloalkyl amine, and an alkyl cycloalkyl amine are more preferred. Furthermore, in terms of good stain resistance, an amine having three or more carbon atoms in total in the amine molecule is preferred, and an amine having five or more carbon atoms in total is more preferred.

The above-mentioned carboxylic acid used as a rust preventive component may be any carboxylic acid. However, preferable examples include a fatty acid, a dicarboxylic acid, a hydroxy fatty acid, naphthenic acid, a resin acid, an oxidized wax, and lanolin fatty acid. Although the carbon number of the above-mentioned fatty acid is not particularly limited, it is preferably 6 to 24, and more preferably 10 to 22. Also, the fatty acid may be a saturated fatty acid or an unsaturated fatty acid, and may also be a linear fatty acid or a branched fatty acid.

Examples of such fatty acids include saturated fatty acids, such as hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, henicosanoic acid, docosanoic acid, tricosanoic acid, and tetracosanoic acid; unsaturated fatty acids, such as hexenoic acid, heptenoic acid, octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecenoic acid, nonadecenoic acid, icosenoic acid, henicosenoic acid, docosenoic acid, tricosenoic acid, and tetracosenoic acid; mixtures thereof; and all the substituted isomers of these fatty acids.

Preferably, a dicarboxylic acid with a carbon number of 2 to 40, and more preferably, a dicarboxylic acid with a carbon number of 5 to 36 are used as a dicarboxylic acid. Among these, a dimer acid that is obtained by dimerizing an unsaturated fatty acid with a carbon number of 6 to 18, or an alkyl succinic acid or an alkenyl succinic acid is preferably used. Examples of dimer acids include the dimer acid derived from oleic acid. Furthermore, among the alkyl succinic acids and alkenyl succinic acids, an alkenyl succinic acid is preferred. An alkenyl succinic acid having an alkenyl group with a carbon number of 8 to 18 is more preferred.

A hydroxy fatty acid with a carbon number of 6 to 24 is preferably used as a hydroxy fatty acid. Also, although the hydroxy fatty acid may have one or more hydroxy groups, a hydroxy fatty acid having 1 to 3 hydroxy groups is preferably used. Examples of such hydroxy fatty acids include ricinoleic acid.

Naphthenic acid is a mixture of carboxylic acids that are included in petroleum and have a —COOH group bound to a naphthene ring. A resin acid is an organic acid that exists in a free state or as an ester in the natural resin. An oxidized wax is obtained by oxidizing wax. Although waxes used as a raw material is not particularly limited, specific examples of such waxes include a paraffin wax, a microcrystalline wax, and petrolatum, which are obtained when refining a petroleum distillate, and a polyolefin wax, which is produced by synthesis.

Lanolin fatty acid is a carboxylic acid that is obtained by refining a waxy material that adheres to wool, for example, by hydrolysis.

Among these carboxylic acids, in terms of the rust preventive effect, degreasing, and storage stability, a dicarboxylic acid is preferred, a dimer acid is more preferred, and the dimer acid derived from oleic acid is even more preferred.

The above-mentioned fatty acid amine salt used as a rust preventive component is a salt formed between a fatty acid exemplified in the description of the above-mentioned carboxylic acid and an amine exemplified in the description of the above-mentioned amine.

Examples of the above-mentioned carboxylate salts used as a rust preventive component include an alkali metal salt, an alkaline earth metal salt, and an amine salt of the above-mentioned carboxylic acid. Examples of alkali metals as a component of a carboxylate salt include sodium and potassium. Examples of alkaline earth metals as a component of a carboxylate salt include barium, calcium, and magnesium. In particular, a calcium salt is preferably used. Meanwhile, amines include the amines exemplified in the description of the amine. The use of a barium salt may lead to insufficient safety regarding the human body or the ecosystem.

Examples of above-mentioned paraffin waxes used as a rust preventive component include a paraffin wax, a microcrystalline wax, and petrolatum, which are obtained by refining a petroleum distillate, and a polyolefin wax that is produced by synthesis.

An oxidized wax used as a raw material for a salt of oxidized wax is not particularly limited. Examples of oxidized waxes include an oxidized paraffin wax produced by oxidizing waxes such as a paraffin wax described above.

When a salt of oxidized wax is an alkali metal salt, examples of alkali metals used as a raw material include sodium and potassium. When a salt of oxidized wax is an alkaline earth metal salt, examples of alkaline earth metals used as a raw material include magnesium, calcium, and barium. When a salt of oxidized wax is a heavy metal salt, examples of heavy metals used as a raw material include zinc and lead. A calcium salt is preferred among them. It should be noted that it is preferable that a salt of oxidized wax be not a barium salt or a heavy metal salt in terms of safety regarding the human body or the organism system.

Examples of the above-mentioned boron compounds used as a rust preventive component include potassium borate and calcium borate.

In the composition of the present invention, one of the rust preventives that are the components (C) described above may be used alone, or a mixture of two or more rust preventives of the same kind may be used. Furthermore, a mixture of two or more rust preventives of different kinds may be used.

As the component (C) used as a rust preventive in the composition of the present invention, a sulfonate salt or a sulfonate ester is preferred since it exhibits a better rust preventive effect in the presence of water. Furthermore, combined use of a sulfonate salt and a sulfonate ester is more preferred.

For example, alcohols represented by higher aliphatic alcohols, and the like; phosphate derivatives and phosphite derivatives represented by phosphomonoesters, phosphodiesters, phosphite esters, amine salts of phosphoric acid and phosphorous acid, and the like may be included as a rust preventive in addition to the above-mentioned rust preventives.

In the composition of the present invention, when the component (C) other than carboxylic acid is used as a rust preventive, the content is not particularly limited; however, in terms of the rust preventive effect, the content is preferably 0.1% by mass or more, more preferably 0.5% by mass or more, and even more preferably 1.0% by mass or more based on the total mass of the composition. Also, when the component (C) other than carboxylic acid is used as a rust preventive, the content is, in terms of storage stability, preferably 20% by mass or less, more preferably 15% by mass or less, and even more preferably 10% by mass or less based on the total mass of the composition.

In the composition of the present invention, when carboxylic acid, which is the component (C), is used as a rust preventive, the content is not particularly limited; however, in terms of the rust preventive effect, the content is preferably 0.01% by mass or more, more preferably 0.03% by mass or more, and even more preferably 0.05% by mass or more based on the total mass of the composition.

When the content of carboxylic acid is less than the above-mentioned lower limit, there is a possibility that the addition of carboxylic acid leads to an insufficient effect in enhancing the rust preventive effect. Furthermore, the content of carboxylic acid is preferably 2% by mass or less, more preferably 1.5% by mass or less, and even more preferably 1% by mass or less based on the total mass of the composition. When the content of carboxylic acid is more than the above-mentioned upper limit, there is a possibility that solubility in the base oil is insufficient and storage stability decreases.

A chlorine bleach is sometimes used for decolorization in manufacturing the above-mentioned rust preventives. However, in the present invention, it is preferable either to use a non-chlorine compound such as hydrogen peroxide as a bleach or not to carry out a decolorization treatment. Additionally, although chlorine compounds such as hydrochloric acid are sometimes used, for example, in hydrolysis of fats and oils, it is also preferable to use either a non-chlorine acid or a basic compound in this case. Furthermore, it is preferable to apply a thorough cleaning treatment such as water washing to the resultant compound.

The concentration of chlorine included in the above-mentioned rust preventive is not particularly limited as long as the property of the composition of the present invention is not impaired; however, the concentration is preferably 200 ppm by mass or less, more preferably 100 ppm by mass or less, even more preferably 50 ppm by mass or less, and particularly preferably 25 ppm by mass or less.

The lower limit of the kinetic viscosity at 40° C. of the rust preventive oil composition of the present invention is 20 $mm^2/s$ or more, and preferably 22 $mm^2/s$ or more. When the kinetic viscosity is less than the above-mentioned lower limit, an oil film cannot be retained and a problem with the rust preventive effect might arise. Meanwhile, the upper limit of the kinetic viscosity at 40° C. of the composition of the present invention is 100 $mm^2/s$ or less, and more preferably 98 $mm^2/s$ or less. The kinetic viscosity more than the above-mentioned upper limit may cause decrease of a rust preventive effect (rust removal effect).

The base number of the composition of the present invention is preferably 1.0 mgKOH/g or more, more preferably 1.2 mgKOH/g or more, and even more preferably 1.5 mgKOH/g or more in terms of the rust preventive effect. Furthermore, the base number is preferably 25 mgKOH/g or less, more preferably 20 mgKOH/g or less, and even more preferably 15 mgKOH/g or less in terms of storage stability. As used herein, "base number" means a base number (mgKOH/g) determined by the hydrochloric acid method in accordance with JIS K 2501 "Petroleum products and lubricants—Determination of neutralization number", Section 6.

The composition of the present invention may include other additives, if required. Specific examples of additives include a paraffin wax, which has a significant effect in enhancing the rust preventive effect in the case of exposure to an acid atmosphere; a sulfurized fat and oil, a sulfurized ester, a long-chain zinc alkyl dithiophosphate, a phosphate ester such as tricresyl diphosphate, an oil and fat such as lard, a fatty acid, a higher alcohol, calcium carbonate, potassium borate, which have a significant effect in enhancing press formability or lubricity; a phenol antioxidant or an amine antioxidant for improving the anti oxidative effect; a corrosion inhibitor for improving anti-corrosive effect, such as benzotriazole or derivatives thereof, thiadiazole, and benzothiazole; a wetting agent such as a diethylene glycol monoalkyl ether; a film forming agent such as an acrylic polymer and slack wax; an antifoaming agent such as methyl silicone, fluoro silicone, and a polyacrylate; a surfactant; and mixtures thereof. It should be noted that, although the other additives described above may be included in any amount, the total content of these additives is preferably 10% by mass or less based on the total mass of the composition of the present invention.

The content of barium, zinc, chlorine, and lead included in the composition of the present invention, which is calculated based on the mass of each chemical element, is preferably 1000 ppm by mass or less, more preferably 500 ppm by mass or less, even more preferably 100 ppm by mass or less, still more preferably 50 ppm by mass or less, further more preferably 10 ppm by mass or less, particularly preferably 5 ppm by mass or less, and most preferably 1 ppm by mass or less based on the total mass of the composition. When the content of at least one of the elements is more than 1000 ppm by mass, safety regarding the human body or the environment such as the ecosystem may be insufficient.

It should be noted that the content of an element as used in the present invention is the value measured by the following method. Specifically, the content of barium, zinc, or lead means a content (ppm by mass) based on the total mass of the composition, which is measured in accordance with ASTM D 5185-95 "Standard Test Method for Determination of Additive Elements, Wear Metals, and Contaminants in Used Lubricating Oils and Determination of Selected Elements in Base Oils by Inductively Coupled Plasma Atomic Emission Spectrometry (ICP-AES)"; the content of chlorine means a content (ppm by mass) based on the total mass of the composition, which is measured in accordance with "IPPROPOSED METHOD AK/81Determination of chlorine Microcoulometry oxidative method", respectively. The detection limit of each element by the above-mentioned measurement methods is usually 1 ppm by mass.

The composition of the present invention can attain each of a rust preventive effect, degreasing, storage stability, and a cleaning effect at a high level and in a good balance, and may be used preferably as a rust preventive oil for various metal parts. In particular, as for a rust preventive effect, the composition maintains A-ranked rust development (0% rust development) for five or more hours in a salt spray test defined in JIS K2246 "Rust preventive oils" and retains an unconventionally excellent effect.

Metal parts as workpieces are not particularly limited. Specific examples include metal plates such as a cold-rolled steel sheet, a hot-rolled steel sheet, and a high-tensile steel sheet, which are used for making a car body or the body of an electrical appliance, surface treated steel sheets such as a galvanized steel sheet, original sheets for making a tin plate, aluminum alloy sheets, and magnesium alloy sheets, and also bearing parts such as a rolling bearing, a taper rolling bearing, and a needle bearing, construction steel, and precision components.

Examples of conventional rust preventive oils for such metal parts include "intermediate rust preventive oil" that is used during the processing process of metal parts, "shipment rust preventive oil" that is used for rust prevention at the time of shipment, "cleaning rust preventive oil" that is used during the cleaning process to remove foreign substances before press working or to remove foreign substances prior to shipment by the metal sheet manufacturer. The cleaning and rust preventive composition of the present invention may be used for all the applications.

The method of coating workpieces with the composition of the present invention is not particularly limited. The metal parts can be coated, for example, by methods such as spray, dropping, transfer using felt material and the like, and electrostatic oil coating. Among these coating methods, a spray method is preferred since it produces an oil film of an even thickness by applying the composition as a fine mist. When the spray method is applied, the coating applicator is not particularly limited as long as it can atomize the composition of the present invention. For example, an air spray applicator, an airless spray applicator, and a hot melt applicator are all applicable. In a coating process, it is preferable to perform a draining process using a centrifuge or a draining process by standing for a long period of time after an excess amount of the washing and rust preventive oil composition is applied.

When the composition of the present invention is used as a cleaning oil, good cleaning and subsequent rust prevention can be achieved by applying a large excess of the composition of the present invention to the surface of a metal part by spraying, showering, dip coating, and the like. Further, adding surface cleaning with a roll brush and the like after the above-mentioned metal processing process as appropriate can increase the efficiency in removal of foreign substances, and the like.

When cleaning is carried out by using the composition of the present invention, it is preferable to perform surface treatment of a metal part using a wringer roll and the like in combination, thereby adjusting the quantity of the oil adherent to the metal part surface.

Irrespective of which is selected from the above-mentioned methods as a coating method for the composition of the present invention, it is preferable to recover, recycle, and reuse the cleaning and rust preventive oil composition that was applied excessively onto the metal part. Additionally, it is preferable to simultaneously remove foreign substances that contaminated the recycling system in the recycle of the composition of the present invention. For example, the foreign substances can be removed by placing a filter in a position in the recycle path of the composition of the present invention, preferably immediately in front of the point where the composition of the present invention is sprayed onto the metal part. Also, a magnet may be placed on the bottom of the tank that stores the composition of the present invention, thereby adsorbing and removing any foreign substances such as worn-out powders by magnetic force.

There is concern that the performance of the composition of the present invention reused in such a process may decrease due to the contamination of the oil derived from the prior process. Therefore, when the composition of the present invention is reused, it is preferable to control its properties by regularly performing measurement of the kinetic viscosity or density, a copper corrosion test, a rust prevention test, and the like for the used oil, and to perform oil renewal, drain disposal, tank cleaning, oil cleaning, and the like as appropriate.

Discarded oil solution may be used without change or after dilution with a solvent or a low viscosity base oil for a line that requires a lower performance of the cleaning and rust preventive oil composition than the line that was used before discarding. Thus, the total amount of oil to be used may be reduced. When the composition of the present invention is stored in a tank, it is preferable to supplement the composition depending on how much the amount of the composition in the tank has been reduced. In this case, the composition to be supplemented may not necessarily have an identical composition to the initially loaded composition. For example, compositions in which a certain additive was increased to enhance a desired performance as appropriate may be supplemented. On the contrary, a composition whose viscosity was reduced, for example by a method of decreasing the content of a high viscosity base oil may be supplemented to maintain the cleaning performance of the cleaning and rust preventive oil composition.

When the composition of the present invention is used in a cleaning process for removing foreign substances prior to shipment by the metal sheet manufacturer, metal sheets can be wound into a coil form or stacked as sheets immediately after the cleaning process and shipped. This method has the advantage that the amount of adhesion of foreign substances is little and that when a cleaning process using the cleaning and rust preventive oil is performed just before a press process in press working, cleaning can also be performed easily and without fail. It should be noted that, as a matter of course, the cleaning process using the cleaning and rust preventive oil in a steel sheet manufacturing factory may be followed by a process of reapplying the rust preventive oil; that is, rust prevention treatment may be performed in two steps.

EXAMPLES

Hereinbelow, the present invention will be described more specifically with reference to Examples and Comparative Examples, but the present invention is not intended to be limited thereto in any way.

Examples 1 to 9 and Comparative Examples 1 to 7

The rust preventive oil compositions according to the present invention were prepared based on the composition shown in Examples 1 to 9 shown in Table 1. The rust preventive oil compositions of Comparative Examples 1 to 7 shown in Table 2 were prepared. The components used for preparing each composition were as follows:

Components (A)

A1: mineral oil having a kinetic viscosity of 1.5 $mm^2/s$ at 40° C.

A2: mineral oil having a kinetic viscosity of 6.2 $mm^2/s$ at 40° C.

A3: mineral oil having a kinetic viscosity of 22.0 $mm^2/s$ at 40° C.

A4: mineral oil having a kinetic viscosity of 93.0 $mm^2/s$ at 40° C.

A5: mineral oil having a kinetic viscosity of 480 $mm^2/s$ at 40° C.

Component (B)

Water (distilled water)

Components (C)

Sarcosine-type compounds

C1: oleoylsarcosine (N-Methyloleamidoacetic acid)

Nonionic surfactants

C2: ethylene oxide adducts of cyclohexylamine (the number of moles of added EO: 2)

C3: ethylene oxide adducts of dicyclohexylamine (the number of moles of added EO: 2)

Sulfonate salts

C4: ethylenediamine sulfonate

C5: basic calcium sulfonate (base number: 95 mgKOH/g)

C6: sodium dinonylnaphthalene sulfonate

Esters

C7: a partial ester of pentaerythritol and lanolin fatty acid

Fatty acid amine salts

C8: octanoic acid alkylamine (D) Other additives

D1: di-t-butyl-p-cresol as an antioxidant

D2: benzotriazol as a metal deactivator

Test methods

<Kinetic Viscosity>

Kinetic viscosity was measured in accordance with JIS K 2283.

<Rust Prevention Test 1 (Humidity Cabinet Test)>

Rust prevention was evaluated in accordance with JIS K 2246-2007 "Rust preventive oils", section 6.34 "Humidity cabinet test method". The time (h) for which A-ranked rust development (0% rust development) was maintained was measured and evaluated.

<Rust Prevention Test 2 (Neutral Salt Spray Test)>

Rust prevention was evaluated in accordance with JIS K 2246-2007 "Rust preventive oils", section 6.35 "Neutral salt spray test". Rust prevention was evaluated by measuring the time (h) by which rust develops. Evaluation was performed every hour.

<Rust Prevention Test 3 (Rust Prevention Test)

The test was performed following the steps below:

(1) an artificial finger print liquid was printed on a cleaned test piece (the same one as used in the humidity cabinet test) in accordance with JIS K 2246-2007, section 6.31 "Fingerprint removability test";

(2) the test piece having a fingerprint printed thereon was dip-coated in a sample oil, and drained to remove excess oil for 24 hours;

(3) the test piece was hung in the same way as a humidity cabinet test and held in a highly humid thermostat adjusted to 50° C. and 95% of relative humidity for 2 weeks.

The presence of the rust development was evaluated after completing the above steps. "Presence" means that rust developed, and "Absence" means that no rust developed.

<Rust Prevention Test 4 (Removability)>

JIS K 2246-2007, section 6.31 "Fingerprint removability test" was carried out and the following evaluation criteria were used.

The evaluation criteria were: very good (no rust), good (a little rust), average to good (not much, but more than a little rust), average (some extent of rust), and poor (rusted). The level of "average to good" to "very good" was considered acceptable.

<Separation Stability>

A rust preventive oil composition was prepared and held in a thermostat adjusted to 25° C., and the occurrence of water separation was determined. "No separation" means that no water separation occurred, and "Separation" means that water separation occurred.

<Moisture Absorption Test>

A 10 g of test oil was placed in a 200 ml glass container and held in a thermostat adjusted to 30° C. and 80% RH for 16 hours, and then the moisture content was measured.

Moisture measuring method: JIS K2275 Karl Fischer's method (using a moisture evaporator)

TABLE 1

| | | | Example 1 | Example 2 | Example 3 | Example 4 | Example 5 | Example 6 | Example 7 | Example 8 | Example 9 |
|---|---|---|---|---|---|---|---|---|---|---|---|
| Composition (% by mass) | (A) component | A1 | | | | | | | | | |
| | | A2 | | | | | | | | | |
| | | A3 | 77.4 | 76.5 | 52.4 | | 75.0 | 79.2 | 73.0 | 80.5 | 80.0 |
| | | A4 | 8.6 | 8.5 | 33.6 | 86.0 | 10.0 | 8.8 | 8.0 | 10.5 | 9.0 |
| | | A5 | | | | | | | | | |
| | (B) | Water | 3 | 3 | 3 | 3 | 3 | 1 | 8 | 1 | *1 |
| | (C) component | C1 | | 1 | | | 1 | | | | |
| | | C2 | 3 | 3 | 3 | 3 | 3 | 3 | 3 | | 3 |
| | | C4 | 4.7 | 4.7 | 4.7 | 4.7 | | 4.7 | 4.7 | 4.7 | 4.7 |
| | | C5 | | | | | 4.7 | | | | |
| | | C6 | | | | | | | | | |
| | | C7 | 2 | 2 | 2 | 2 | 2 | 2 | 2 | 2 | 2 |
| | | C8 | 1 | 1 | 1 | 1 | 1 | 1 | 1 | 1 | 1 |
| | (D) | D1 | 0.2 | 0.2 | 0.2 | 0.2 | 0.2 | 0.2 | 0.2 | 0.2 | 0.2 |
| | | D2 | 0.1 | 0.1 | 0.1 | 0.1 | 0.1 | 0.1 | 0.1 | 0.1 | 0.1 |
| Kinetic viscosity at 40° C. ($mm^2/s$) | | | 28.2 | 28.5 | 41.2 | 95.7 | 27.5 | 28.3 | 28.4 | 27.5 | 28.5 |
| Base number (mgKOH/g) | | | 10.5 | 10.6 | 10.5 | 10.5 | 14.6 | 10.5 | 10.5 | 1.7 | 10.5 |
| Rust prevention test-1 (h) | | | ≥1800 | ≥1800 | ≥1800 | ≥1800 | ≥1800 | ≥1800 | ≥1800 | ≥1800 | ≥1800 |
| Rust prevention test-2 (h) | | | 20 | 24 | 22 | 36 | 28 | 20 | 20 | 20 | 20 |
| Rust prevention test-3 (Presence or absence) | | | Absence | Absence | Absence | Absence | Absence | Absence | Absence | Absence | Absence |
| Rust prevention test-4 | | | Good | Good | Good | Average to good | Good | Good | Good | Good | Good |

TABLE 1-continued

| | Example 1 | Example 2 | Example 3 | Example 4 | Example 5 | Example 6 | Example 7 | Example 8 | Example 9 |
|---|---|---|---|---|---|---|---|---|---|
| Separation stability (Presence or absence) | Absence | Absence | Absence | Absence | Absence | Absence | Absence | Absence | Absence |
| Moisture absorption test (ppm by mass) | — | — | — | — | — | — | — | — | 12000 |

"—" in the moisture absorption test denotes "not measured".

*1 The water content by absorption of the moisture in the air after the application of a rust preventive composition to metal parts is 0.1% by mass or more.

TABLE 2

| | | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|---|
| Composition (% by mass) | (A) component | A1 | 4.3 | | | | 55.2 | | |
| | | A2 | 81.7 | | | | | 80.5 | 59.4 |
| | | A3 | | 30.1 | 84.6 | 62.1 | | | |
| | | A4 | | | 7.4 | 6.9 | 37.0 | 11.7 | 32.8 |
| | | A5 | | 55.9 | | | | | |
| | (B) | Water | 3 | 3 | | 20 | 1 | 1 | 1 |
| | (C) component | C1 | | | | | | | |
| | | C2 | 3 | 3 | | 3 | | | |
| | | C3 | | | | | 0.5 | 0.5 | 0.5 |
| | | C4 | 4.7 | 4.7 | 4.7 | 4.7 | 2 | 2 | 2 |
| | | C5 | | | | | | | |
| | | C6 | | | | | 2 | 2 | 2 |
| | | C7 | 2 | 2 | 2 | 2 | 2 | 2 | 2 |
| | | C8 | 1 | 1 | 1 | 1 | | | |
| | (D) | D1 | 0.2 | 0.2 | 0.2 | 0.2 | 0.2 | 0.2 | 0.2 |
| | | D2 | 0.1 | 0.1 | 0.1 | 0.1 | 0.1 | 0.1 | 0.1 |
| Kinetic viscosity at 40° C. ($mm^2/s$) | | | 7.1 | 123 | 27.8 | Not tested since water separation occurred. | 6.7 | 10.6 | 15.0 |
| Base number (mgKOH/g) | | | 11.7 | 11.7 | 2.7 | | 1.9 | 1.9 | 1.9 |
| Rust prevention test-1 | | | 1200 | ≥1800 | ≥1800 | | 1300 | 1400 | 1600 |
| Rust prevention test-2 | | | 8 | 42 | 20 | | 3 | 3 | 4 |
| Rust prevention test-3 | | | Absence | Absence | Presence | | Absence | Absence | Absence |
| Rust prevention test-4 | | | Very good | Poor | Poor | | Absence | Absence | Absence |
| Separation stability | | | Absence | Absence | Absence | Presence | Absence | Absence | Absence |
| Moisture absorption test (ppm by mass) | | | — | — | 750 | — | — | — | — |

"—" in the moisture absorption test denotes "not measured".

INDUSTRIAL APPLICABILITY

The present invention provides a composition that may be used as a rust preventive oil composition. In particular, the composition of the present invention can suppress rust development on metal parts that are subjected to heat treatment over a long period of time, thus offering a high performance.

The invention claimed is:

1. A rust preventive composition comprising (A) a base oil that is at least one oil selected from a mineral oil and a synthetic oil;

(B) 0.1 to 10% by mass of water based on a total mass of the composition; and (C) 0.1 to 20% by mass of rust preventive additives comprising (c1) at least one species of sulfonate salt selected from thr group consisting of an alkali metal sulfonate, an alkaline earth metal sulfonate and an amine sulfonate, (c2) an ester, and (c3) a specific nonionic surfactant consisting of a polyoxyalkylene alkylamine;

wherein the rust preventive oil composition has a kinetic viscosity of 20 to 100 $mm^2/s$ at 40° C., wherein the polyoxyalkylene alkylamine is a polyalkyleneoxide adduct of a mono- or a di-cycloalkyl amine.

2. The rust preventive oil composition according to claim 1, wherein a base number of the rust preventive oil composition is 1 to 25 mg KOH/g.

3. The rust preventive oil composition according to claim 1, further comprising at least one rust preventive additive selected from the group consisting of a sarcosine-type compound, an amine, a carboxylic acid, a fatty acid amine salt, a carboxylate salt, paraffin wax, a salt of oxidized wax, and a boron compound.

4. The rust preventive oil composition according to claim 3, wherein a base number of the rust preventive composition is 1 to 25 mg KOH/g.

5. The rust preventive composition according to claim 3, wherein the base oil is the mineral oil.

6. The rust preventive composition according to claim 3, wherein the ester is at least one selected from the group consisting of a partial ester of a polyalcohol, esterified oxidized wax, esterified lanolin fatty acid, and an alkyl succinate ester or an alkenyl succinate ester.

7. The rust preventive composition according to claim 1, wherein the base oil is the mineral oil.

8. The rust preventive composition according to claim 1, wherein the ester is at least one selected from the group consisting of a partial ester of a polyalcohol, esterified oxidized wax, esterified lanolin fatty acid, and an alkyl succinate ester or an alkenyl succinate ester.

9. The rust preventive composition according to claim 1, wherein the content of barium, zinc, chlorine, and lead included in the composition, which is calculated based on the mass of each chemical element, is 1000 ppm by mass or less.

10. The rust preventive composition according to claim 1, wherein the sulfonate salt consists of the amine sulfonate.

11. The rust preventive oil composition according to claim 10, further comprising at least one rust preventive additive selected from the group consisting of a sarcosine-type compound, an amine, a carboxylic acid, a fatty acid amine salt, a carboxylate salt, a paraffin wax, a salt of oxidized wax, and a boron compound.

12. The rust preventive composition according to claim 10, wherein the ester is at least one selected from the group consisting of a partial ester of a polyalcohol, an esterified oxidized wax, an esterified lanolin fatty acid, an alkyl succinate ester, and an alkenyl succinate ester.

* * * * *